United States Patent [19]

Blanchard

[11] 4,362,514

[45] Dec. 7, 1982

[54] HIGH PERFORMANCE STERN DRIVE UNIT

[75] Inventor: Clarence E. Blanchard, Kenosha, Wis.

[73] Assignee: Outboard Marine Corporation, Waukegan, Ill.

[21] Appl. No.: 183,941

[22] Filed: Sep. 4, 1980

[51] Int. Cl.[3] ..... B63H 5/13

[52] U.S. Cl. ..... 440/61

[58] Field of Search ..... 440/53, 57–63

[56] References Cited

U.S. PATENT DOCUMENTS

| | | | |
|---|---|---|---|
| 3,626,467 | 12/1971 | Mazziotti | 440/61 |
| 3,933,116 | 1/1976 | Adams et al. | 440/61 |
| 3,958,525 | 5/1976 | Luthman | 440/59 |

FOREIGN PATENT DOCUMENTS

| | | | |
|---|---|---|---|
| 2224626 | 12/1972 | Fed. Rep. of Germany | 440/61 |

*Primary Examiner*—Sherman D. Basinger

*Attorney, Agent, or Firm*—Michael, Best & Friedrich

[57] ABSTRACT

Disclosed herein is a marine propulsion device comprising a bracket adapted to be fixed to a boat transom and having an upper portion and a lower portion, a propulsion leg including a rotatably mounted propeller, a first ball joint universally connecting the propulsion leg and the lower bracket portion, a hydraulic cylinder-piston assembly having first and second ends, a pivot connecting the first end of the hydraulic cylinder-piston assembly to the propulsion leg about an axis which is generally horizontal when the bracket is boat mounted, a second ball joint universally connecting the second end of the hydraulic cylinder-piston assembly to the upper bracket portion, and a drive train adapted to be connected to a prime mover, extending through the bracket and the propulsion leg, and drivingly connected to the propeller.

17 Claims, 2 Drawing Figures

HIGH PERFORMANCE STERN DRIVE UNIT

BACKGROUND OF THE INVENTION

The invention relates generally to marine propulsion devices, and more particularly, to stern drive units.

Still more particularly, the invention relates to arrangements for mounting a propulsion leg from the transom of a boat so as to enable steering movement of the propulsion leg and vertical tilting movement of the propulsion leg for the purpose or trimming the propulsion leg to maximize propulsion efficiency.

Attention is directed to the following U.S. Pat. Nos.: Wanzer 2,755,766 Issued July 24, 1956, Hansson et al 3,003,311 Issued Oct. 31, 1961, Shimanckas 3,183,880 Issued May 18, 1965, MacDonald et al 3,368,517 Issued Feb. 13, 1968, Wynne 3,376,842 Issued Apr. 9, 1968, Warburton 3,403,655 Issued Oct. 1, 1968, Strang 3,841,257 Issued Oct. 15, 1974, Lohse 3,888,203 Issued June 10, 1975, Adams, et al 3,933,116 Issued Jan. 20, 1976.

SUMMARY OF THE INVENTION

The invention provides a marine propulsion device comprising a bracket adapted to be fixed to a boat transom and having an upper portion and a lower portion, a propulsion leg including a rotatably mounted propeller, a first universal coupling connecting the propulsion leg and one of the bracket portions, an extensible and contractable rigid link having first and second ends, means pivotally connecting the first end of the rigid link to the propulsion leg about an axis which is generally horizontal when the bracket is boat mounted, a second universal coupling connecting the second end of the rigid link to the other of the bracket portions, and a drive train adapted to be connected to a prime mover, extending through the bracket and the propulsion leg, and drivingly connected to the propeller.

In one embodiment of the invention, the first universal coupling is connected to the lower bracket portion and the second universal coupling is connected to the upper bracket portion.

In one embodiment of the invention, the bracket includes, between the upper and lower portions, a sleeve portion, the propulsion leg includes, below the means pivotally connecting the propulsion unit to the rigid link and above the first universal coupling, a forwardly opening sleeve portion in alignment with the sleeve portion of the bracket, a flexible annular member extends between the sleeve portions of the bracket and the propulsion leg, and the drive train extends through the sleeve bracket portion, through the flexible annular member, and through the sleeve portion of the propulsion leg.

In one embodiment of the invention, the first and second universal couplings comprise ball joints.

In one embodiment of the invention, the first and second universal couplings are located in a common vertical plane extending through the axis of the sleeve portions and the steering axis extends in the vertical plane and through the center of the universal couplings in upwardly and forwardly inclined relation.

In one embodiment of the invention, the rigid link comprises a hydraulic cylinder-piston assembly.

In one embodiment of the invention, the hydraulic cylinder-piston assembly and the propulsion leg include surfaces affording relative movement therebetween while accommodating transmission of side thrust from the propulsion leg to the hydraulic cylinder-piston assembly.

In one embodiment of the invention, the hydraulic cylinder-piston assembly is extended when the propulsion leg is in the normal running position.

Other features and advantages of the embodiments of the invention will become known by reference to the following general description, claims and appended drawings.

THE DRAWINGS

Figure 1:
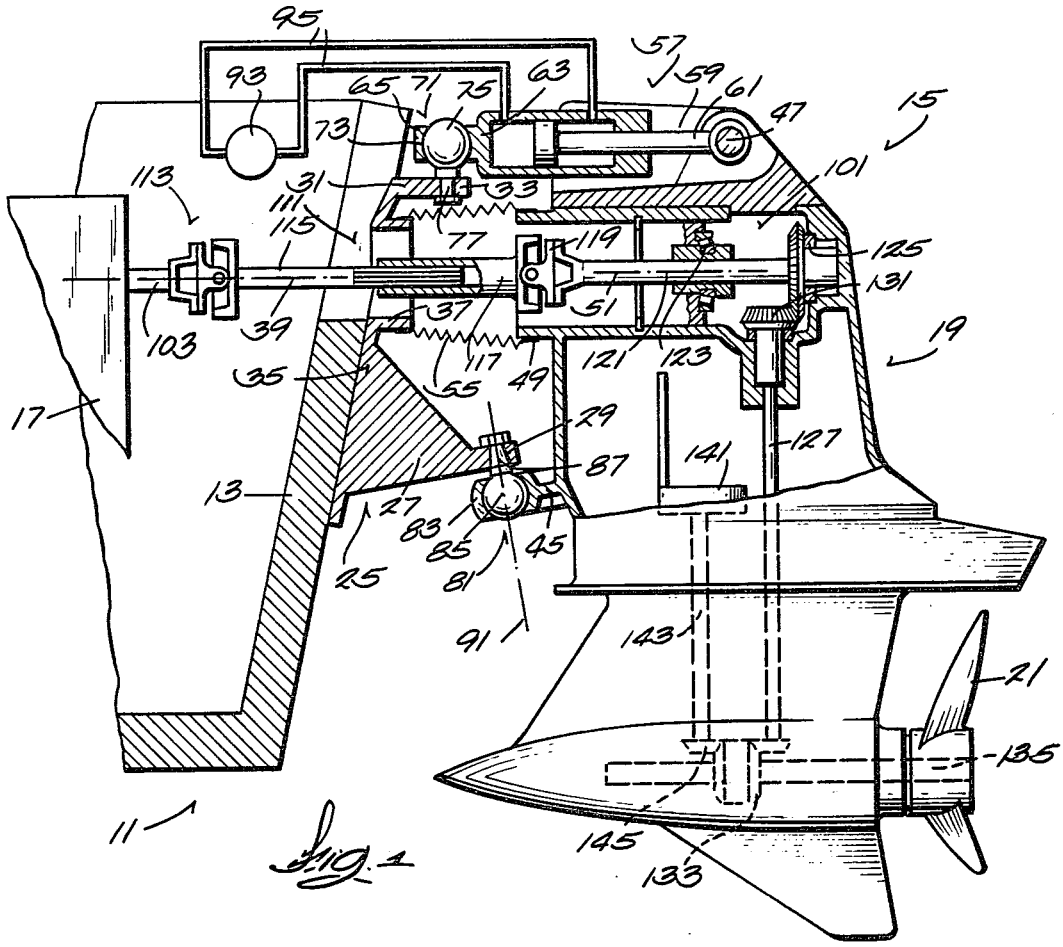
FIG. 1 is a partially schematic, side elevational view, partially in section, of a marine propulsion device incorporating various of the features of the invention.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in the drawings is a marine propulsion device which is mounted on a boat hull 11 including a transom 13 and which is generally in the form of a stern drive unit 15 including boat mounted prime mover or engine 17 (shown schematically) and a propulsion leg 19 which rotatively supports a propeller 21 and which is supported from the transom 13 for pivotal tilting and steering movements.

The propulsion leg 19 is supported from the transom 13 by means including a transom bracket 25 which is fixed by any suitable means on the transom 13 and which includes a lower portion 27 having a slightly upwardly and rearwardly inclined mounting ear 29, together with an upper portion 31 having a generally horizontally and rearwardly extending mounting ear 33, and a central portion 35 joining the upper and lower portions 31 and 27 and including a sleeve portion 37 which is preferably generally cylindrical and which has a fore and aft generally horizontal axis 39. As shown, the lower mounting ear 29 extends rearwardly further than the upper mounting ear 33.

The propulsion leg 19 includes a central part having a mounting arm 45 which inclines forwardly and downwardly and, adjacent the upper end thereof, a transverse generally horizontal pivot pin 47, together with a sleeve portion 49 which is loated intermediate the pivot pin 47 and the mounting arm 45, which is forwardly open, which is preferably cylindrical, and which has an axis 51 which is generally coincident with the axis 39 of the sleeve portion 37 of the transom bracket 25.

Connected to and extending between the sleeve portions 37 and 49 of the transom bracket 25 and the propulsion leg 19 is a flexible tube or boot 55 which is of accordian configuration and which can be constructed of rubber or rubberlike material.

Means are provided for tiltably and steerably connecting the propulsion leg 19 to the transom bracket 25.

While various constructions can be employed, in the disclosed construction, such means includes an extendible and contractible rigid link. While various arrangements can be employed, in the illustrated construction, such rigid link comprises a hydraulic cylinder-piston assembly 57 which extends at least in part, in a recess 59 in the upper end of the propulsion leg 19 and which is pivotally connected, at its rearward end 61, to the pivot pin 47 adjacent the upper end of the propulsion leg 19.

The end 63 of the hydraulic cylinder-piston assembly 57 includes a forwardly extending mounting arm 65 which is connected to the upper rearwardly extending mounting ear 33 of the transom bracket 25 by a first or upper universal coupling 71 accommodating pivotal movement of the propulsion leg 19 relative to the transom bracket 25 in both the horizontal and vertical planes to provide for both steering of the propulsion leg 19 and for trim adjustment of the propulsion leg 19. While various arrangements can be employed, in the illustrated construction, the upper universal coupling 71 comprises a spherical socket 73 formed in the mounting arm 65 of the hydraulic cylinder-piston assembly and a ball 75 which is movably received in the socket 73 and which extends from a stud 77 fixed to the upper mounting ear 33 extending from the transom bracket 25.

Still further in addition, the means for tiltably and steerably connecting the propulsion leg 19 to the transom bracket 25 comprises a second or lower universal coupling 81 connecting the mounting arm 45 of the propulsion leg 19 and the lower mounting ear 29 of the transom bracket 25. While various arrangements can be employed, in the illustrated construction, such lower universal coupling 81 includes a spherical socket 83 formed in the mounting arm 45 of the propulsion leg 19 and a ball 85 which is movably received in the socket 83 and which extends from a stud 87 fixed to the lower mounting ear 29 at a point rearwardly of the location of the fixation of the upper ball 75 of the upper universal coupling 71.

In is noted that, as a result of the construction just described, the propulsion leg steering axis 91 passes through the centers of the balls 75 and 85 and slightly inclines upwardly and forwardly. Tilting occurs about a transverse tilt axis extending through the center of the lower ball 85.

The hydraulic cylinder-piston assembly 57 also serves as means for tiltably displacing the propulsion leg 19 relative to the transom bracket 25 about the tilt axis so as to enable trimming of the propulsion leg 19 relative to the boat 11 to maximize propulsion efficiency.

When the propulsion leg 19 is in the normal running position, the hydraulic cylinder-piston assembly 57 is extended. Any suitable means can be connected to the hydraulic cylinder-piston assembly 57 for selectively supplying pressure fluid thereto so as to contract and expand the hydraulic cylinder-piston assembly 57 and thereby adjust the trim position of the propulsion leg 19. In the disclosed construction, a hydraulic pump 93 is schematically shown located inboard of the transom 13 and connected to the opposite ends of the hydraulic cylinder-piston assembly 57 by a pair of hydraulic conduits 95.

Any suitable means (not shown) can be employed for effecting steering movement of a propulsion leg 19 about the steering axis 91.

Also included in the disclosed construction is a drive train 101 which drivingly connects the propeller 21 with the engine 17. More specifically, the drive train 101 includes an output shaft 103 which can extend from the engine 17, or if desired, from an inboard reversing or speed transmission (not shown), and which is connected to a double universal joint and extensible shaft assembly 111 which extends through the transom 13 and through the sleeve portion 37 of the transom bracket 25, through the boot or tube 55, and through the sleeve portion 49 of the propulsion leg 19. Use of the double universal joint and extensible shaft assembly 111 affords continuity of power delivery from the engine 17 to the propeller 21 notwithstanding trimming and steering movements of the propulsion leg 19 relative to the transom bracket 25. More specifically, the double universal joint and extensible shaft assembly 111 includes a first universal joint 113 connected to the output shaft 103, which first universal joint 113, in turn, is connected to a first stub shaft 115 telescopically splined to a second stub shaft 117 which, in turn, is connected through a second universal joint 119 to a shaft 121 supported by bearings 123 and 125 in the propulsion leg 19.

Within the propulsion leg, the drive train 101 also includes a vertical drive shaft 127 which, at its upper end, is connected by a bevel gear set 131 to the shaft 121 and which, at its lower end, is connected by a bevel gear set 133 to a shaft 135 carrying the propeller 21.

The propulsion leg 19 also includes a water pump 141 which is driven by a shaft 143 connected by a bevel gear set 145 to the propeller shaft 135 and which includes suitable inlet and discharge conduits (not shown).

Figure 2:
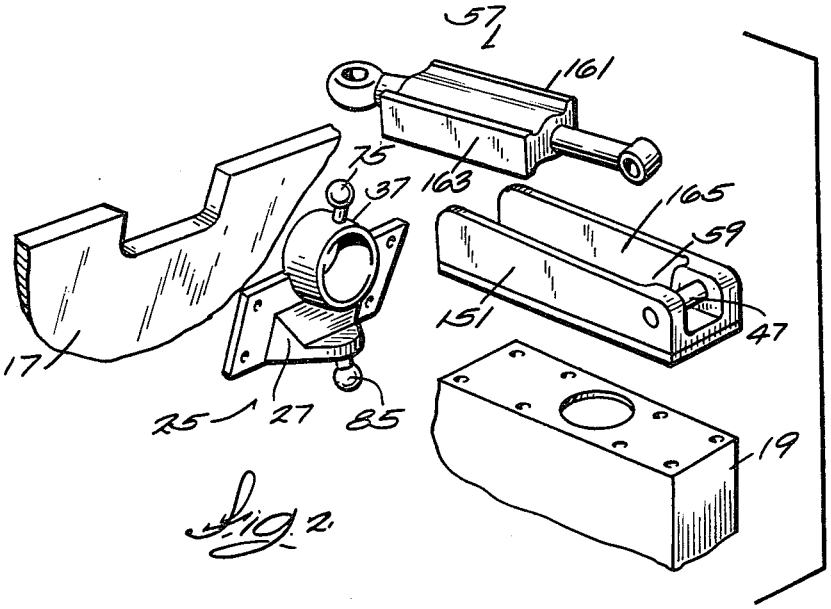
FIG. 2 is a fragmentary exploded perspective view of another embodiment of a marine propulsion device embodying modifications of the structure shown in FIG. 1.

Alternatively, as shown in FIG. 2, the upper ball 75 may be mounted directly to the sleeve portion 37 of the transom bracket 25. In addition, the recess 59 previously referred to can be formed in a bracket or member 151 which is suitably attached to the upper part of the propulsion leg 19. In addition, the hydraulic cylinder-piston assembly 57 can be formed so as to include a cylinder 161 fabricated such that the external side surfaces 163 thereof mate closely with the fore and aft internal side surfaces 165 of the recess 59 so as to permit movement of the cylinder 161 in the fore and aft direction relative to the recess 59 while, at the same time, affording transmission of side thrust from the propulsion leg 17 to the hydraulic cylinder-piston assembly 57.

Various of the features of the invention are set forth in the following claims.

I claim:

1. A marine propulsion device comprising a bracket adapted to be fixed to a boat transom and having an upper portion and a lower portion, a propulsion leg including a rotatably mounted propeller, a first ball joint coupling connecting said propulsion leg and one of said bracket portions, an extensible and contractable rigid link having first and second ends, means pivotally connecting said first end of said rigid link to said propulsion leg about an axis which is generally horizontal when said bracket is boat mounted, a second ball joint coupling connecting said second end of said rigid link to the other of said bracket portions, and a drive train adapted to be connected to a prime mover, extending through said bracket and said propulsion leg, and drivingly connected to said propeller.

2. A marine propulsion device in accordance with claim 1 wherein said first ball joint coupling is connected to said lower bracket portion and second ball joint coupling is connected to said upper bracket portion.

3. A marine propulsion device in accordance with claim 1 wherein said bracket includes, between said upper and lower portions, a sleeve portion, wherein said propulsion leg includes, below said means pivotally connecting said propulsion unit to said rigid link and above said first ball joint coupling, a forwardly opening sleeve portion in alignment with said sleeve portion of said bracket, wherein a flexible annular member extends between said sleeve portions of said bracket and said propulsion leg, and wherein said drive train extends through said sleeve bracket portion through said flexible annular member, and through said sleeve portion of said propulsion leg.

4. A marine propulsion device in accordance with claim 1 wherein said first and second ball joint couplings are located in a common vertical plane extending through the axis of said sleeve portions and wherein said device has a steering axis extending in said vertical plane and through the center of said ball joint couplings in upwardly and forwardly inclined relation.

5. A marine propulsion device in accordance with claim 1 wherein said rigid link comprises a hydraulic cylinder-piston assembly.

6. A marine propulsion device in accordance with claim 5 wherein said hydraulic cylinder-piston assembly and said propulsion leg include surfaces affording relative movement therebetween in the direction of the axis of said cylinder-piston assembly while accommodating transmission of side thrust from said propulsion leg to said hydraulic cylinder-piston assembly.

7. A marine propulsion device in accordance with claim 5 wherein said hydraulic cylinder-piston assembly is extended when said propulsion leg is in the normal running position.

8. A marine propulsion device in accordance with claim 5 and further including means for selectively supplying hydraulic fluid to said hydraulic cylinder-piston assembly so as to selectively effect extension and contraction thereof.

9. A marine propulsion device comprising a bracket adapted to be fixed to a boat transom and having an upper portion and a lower portion, a propulsion leg including a rotatably mounted propeller, a drive train adapted to be connected to a prime mover, and including a horizontal portion extending through said bracket and to said propulsion leg, and drivingly connected to said propeller, a first coupling providing pivotal movement about a horizontal axis and a vertical axis, located in vertically spaced relation to said horizontal portion of said drive train, and connecting said propulsion leg and one of said bracket portions, an extensible and contractable rigid link having first and second ends, means pivotally connecting said first end of said rigid link to said propulsion leg about a horizontal axis, and a second coupling providing pivotal movement about a horizontal axis and a vertical axis, located in vertically spaced relation to said drive train, and connecting said second end of said rigid link to the other of said bracket portions.

10. A marine propulsion device in accordance with claim 9 wherein said first coupling is connected to said lower bracket portion and second coupling is connected to said upper bracket portion.

11. A marine propulsion device in accordance with claim 9 wherein said bracket includes, between said upper and lower portions, a sleeve portion, wherein said proulsion leg includes, below said means pivotally connecting said propulsion unit to said rigid link and above said first coupling, a forwardly opening sleeve portion in alignment with said sleeve portion of said bracket, wherein a flexible annular member extends between said sleeve portions of said bracket and said propulsion leg, and wherein said drive train extends through said sleeve bracket portion through said flexible annular member, and through said sleeve portion of said propulsion leg.

12. A marine propulsion device in accordance with claim 9 wherein said first and second couplings comprise ball joints.

13. A marine propulsion device in accordance with claim 9 wherein said first and second couplings are located in a common vertical plane extending through the axis of said sleeve portions and wherein said device has a steering axis extending in said vertical plane and through the center of said couplings in upwardly and forwardly inclined relation.

14. A marine propulsion device in accordance with claim 9 wherein said rigid link comprises a hydraulic cylinder-piston assembly.

15. A marine propulsion device in accordance with claim 14 wherein said hydraulic cylinder-piston assembly and said propulsion leg include surfaces affording relative movement therebetween in the direction of the axis of said cylinder-piston assembly while accommodating transmission of side thrust from said propulsion leg to said hydraulic cylinder-piston assembly.

16. A marine propulsion device in accordance with claim 14 wherein said hydraulic cylinder-piston assembly is extended when said propulsion leg is in the normal running position.

17. A marine propulsion device in accordance with claim 14 and further including means for selectively supplying hydraulic fluid to said hydraulic cylinder-piston assembly so as to selectively effect extension and contraction thereof.

* * * * *